US005155870A

United States Patent [19]

Tsutsui et al.

[11] Patent Number: 5,155,870

[45] Date of Patent: Oct. 20, 1992

[54] WATER CLOSET FLUSHING APPARATUS

[75] Inventors: Osamu Tsutsui; Atsuo Makita; Hirofumi Takeuchi; Shinji Shibata; Noboru Shinbara, all of Chigasaki, Japan

[73] Assignee: Toto Ltd., Kanagawa, Japan

[21] Appl. No.: 576,261

[22] Filed: Aug. 31, 1990

[30] Foreign Application Priority Data

| | | | |
|---|---|---|---|
| Sep. 1, 1989 | [JP] | Japan | 1-228007 |
| Sep. 1, 1989 | [JP] | Japan | 1-228009 |
| Sep. 1, 1989 | [JP] | Japan | 1-228010 |
| Sep. 1, 1989 | [JP] | Japan | 1-228031 |
| Sep. 1, 1989 | [JP] | Japan | 1-228032 |
| Sep. 1, 1989 | [JP] | Japan | 1-228033 |
| Sep. 1, 1989 | [JP] | Japan | 1-228035 |
| Sep. 1, 1989 | [JP] | Japan | 1-228036 |
| Sep. 1, 1989 | [JP] | Japan | 1-228037 |
| Sep. 1, 1989 | [JP] | Japan | 1-228045 |
| Sep. 1, 1989 | [JP] | Japan | 1-228049 |

[51] Int. Cl.[5] ..... E03D 1/00

[52] U.S. Cl. ..... 4/300; 4/DIG. 3

[58] Field of Search ..... 4/300, 302, 313, 366, 4/367, 375, 379, 406, DIG. 3; 137/487.5, 486, 505.15, 505.14, 505.13

[56] References Cited

U.S. PATENT DOCUMENTS

| | | | |
|---|---|---|---|
| 3,902,201 | 9/1975 | Bobo | 4/366 |
| 4,672,689 | 6/1987 | Heinze et al. | 4/415 |
| 4,877,051 | 10/1989 | Day | 137/486 |

*Primary Examiner*—Henry J. Recla
*Assistant Examiner*—David J. Walczak
*Attorney, Agent, or Firm*—Ladas & Parry

[57] ABSTRACT

A water closet flushing apparatus provided with a pressure detector mounted along a water supply pipe, an opening and closing apparatus to open and close a water supply passage provided along the water supply pipe and a control apparatus that uses the pressure detected by the pressure detector to control the opening and closing operation of the opening and closing apparatus so that a predetermined amount of water is supplied to the water closet.

13 Claims, 12 Drawing Sheets

WATER CLOSET FLUSHING APPARATUS

BACKGROUND OF THE INVENTION

The present invention relates to a water closet flushing apparatus and more particularly, to a water closet flushing apparatus which can supply a predetermined quantity of water irrespective of fluctuations in the supply pressure of the flushing water.

Water closets of the flushing type are provided with a bowl portion having a bowl shape and in which excreta is received and held, and a trap discharge passage having the shape of an inverted letter "U" and which communicates with a bottom portion of this bowl portion.

The quantity of flushing water that is supplied to the water closet must be a quantity that can clean the bowl portion and that can also generate a syphon action in the trap discharge path and thus completely discharge the water containing excreta. The value for this quantity of water is predetermined by the shape and size of the water closet, and its purpose of use.

In conventional flushing apparatus, there is known a type where an automatic opening and closing valve apparatus is used as the means to control the quantity of flushing water supplied. In this, case, the water supply pressure of the flushing water is assumed to be constant, and the valve opens and closes for a predetermined time to supply the flushing water.

However, the water supply pressure of the flushing water often varies due to factors such as the location where the water closet is installed and the time that the water closet is used, and it is not possible to ensure a predetermined quantity of water by simply controlling the time for which the valve is open. Because of this, the general method involves holding the valve open for a longer time than is necessary, and supplying a quantity of flushing water that is greater than a predetermined quantity. Another method that can be thought of involves setting the water supply pressure to a high pressure beforehand but doing this involves the supply of a larger quantity of flushing water than is necessary, and therefore flushing water is also wasted with this method. In addition, when the supply water pressure becomes high, there is also the problem of the flushing water splashing to outside of the bowl when the water closet is flushed.

Because of this, development is being performed for a water closet flushing apparatus that performs the opening and closing control of an automatic opening and closing valve by providing a flow meter along a water supply pipe and measuring the quantity of flushing water supplied (such as for example, Japanese Patent Laid-Open Publication No. 114734/1988).

However, in the case where a flow meter is used, it is necessary to have a large installation shape since the flow meter itself is large. In addition, there is a large water pressure loss because of the need to drive a gear mechanism for the flow meter calculations and in particular, in the case where there is a low water supply pressure, this influence of the pressure loss creates the problem of difficulty in performing accurate flow quantity control. In addition, the flow quantity control meter uses a gear mechanism and so the response is slow and it is not possible to accurately detect the flow quantity when flushing water supply commences and when there are instantaneous changes in the flow. Furthermore, in order for the flow meter to detect the actual quantity of water that is flowing, the flow meter is disposed on the upstream side of the opening and closing valve and when the water is cut off, does not function to predict abnormalities in the water supply system beforehand.

In addition, recently, for the purposes of reducing the amount of flushing water that is supplied to the water closet and to definitely generate the syphon action necessary in the trap discharge passage to perform flushing, there has been used a method in which separate water supply systems are used to supply flushing water to the bowl portion and the trap discharge passage (such as for example, Japanese Patent Laid-Open Publication No. 30092/1980). In this case as well, it is necessary to supply predetermined amounts of flushing water to the water supply passages of the separate systems but if there is a fluctuation in the water supply pressure, then for the same reason as has already been described, there is the problem of the optimum flushing effect not being attained.

SUMMARY OF THE INVENTION

The present invention is proposed in order to solve the problems described above, and has as an object the provision of a water closet flushing apparatus that can supply a predetermined quantity of flushing water irrespective of fluctuations in the water supply pressure.

Another object of the present invention is to provide a water closet flushing apparatus that can perform adequate flushing operation even in places where the water supply pressure is lower than a predetermined pressure.

The objects of the present invention described above, is to achieve a configuration having a flushing water supply source and a water supply pipe forming a water supply path in which flushing water flows and which is connected to a water supply hole provided in a water closet, a pressure detection means mounted along a water supply pipe, and an opening and closing means to open and close a water supply passage provided along the water supply pipe, so that the pressure detected by the pressure detection means is used as the basis for the a control means to control the opening and closing operation of the opening and closing means so that the predetermined quantity of water is supplied to the water closet.

Still another object of the present invention is attained by providing the control means with a water quantity setting means to set the necessary amount of supply water, a pressure comparison means to compare the predetermined water supply pressure and the pressure detected by the pressure detection means, and a water supply quantity set value changing means to increase the set water supply quantity of the water supply quantity setting means when the pressure detected as the result of the pressure comparison is lower than a predetermined water supply pressure.

According to the present invention, the pressure of water closet flushing water in a water supply passage is detected and this detected pressure is used as the basis for the opening and closing control of the water supply passage so that the predetermined amount of flushing water is supplied to the water closet.

Still furthermore, according to the present invention, the detected pressure and the predetermined water supply pressure are compared and opening and closing control of the water supply passage is performed so that a quantity of flushing water larger than the predetermined quantity of flushing water is supplied to the water closet when the detected pressure is lower than the predetermined water pressure.

DESCRIPTION OF THE PREFERRED EMBODIMENTS

Figure 1:
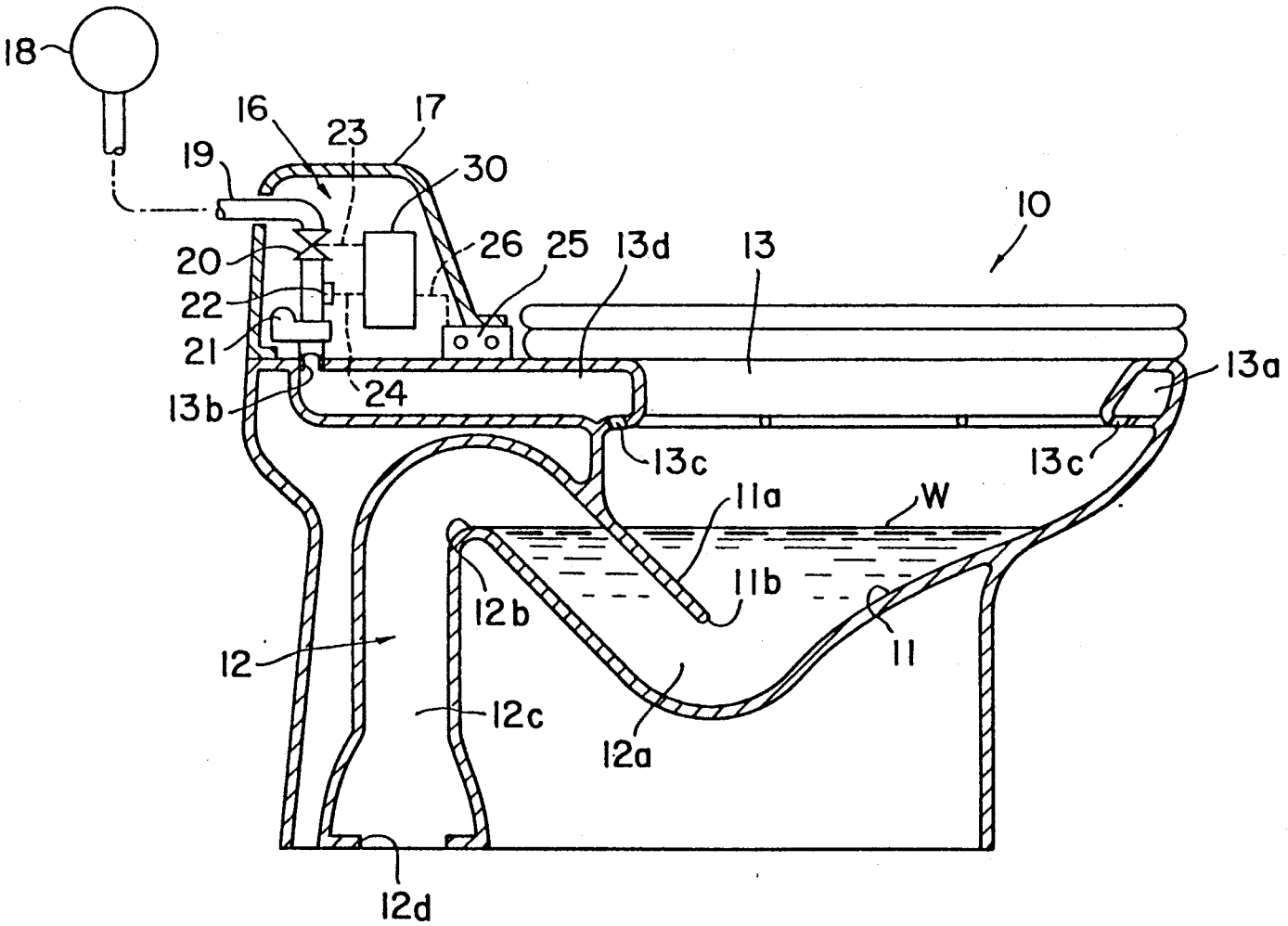
FIG. 1 and FIG. 2 indicate a first embodiment of the water closet flushing apparatus according to the present invention, with FIG. 1 being a sectional view indicating the example of the application of the present invention to a flushing water closet, and FIG. 2 being a block diagram indicating the configuration of the main portions of the apparatus.
Figure 2:
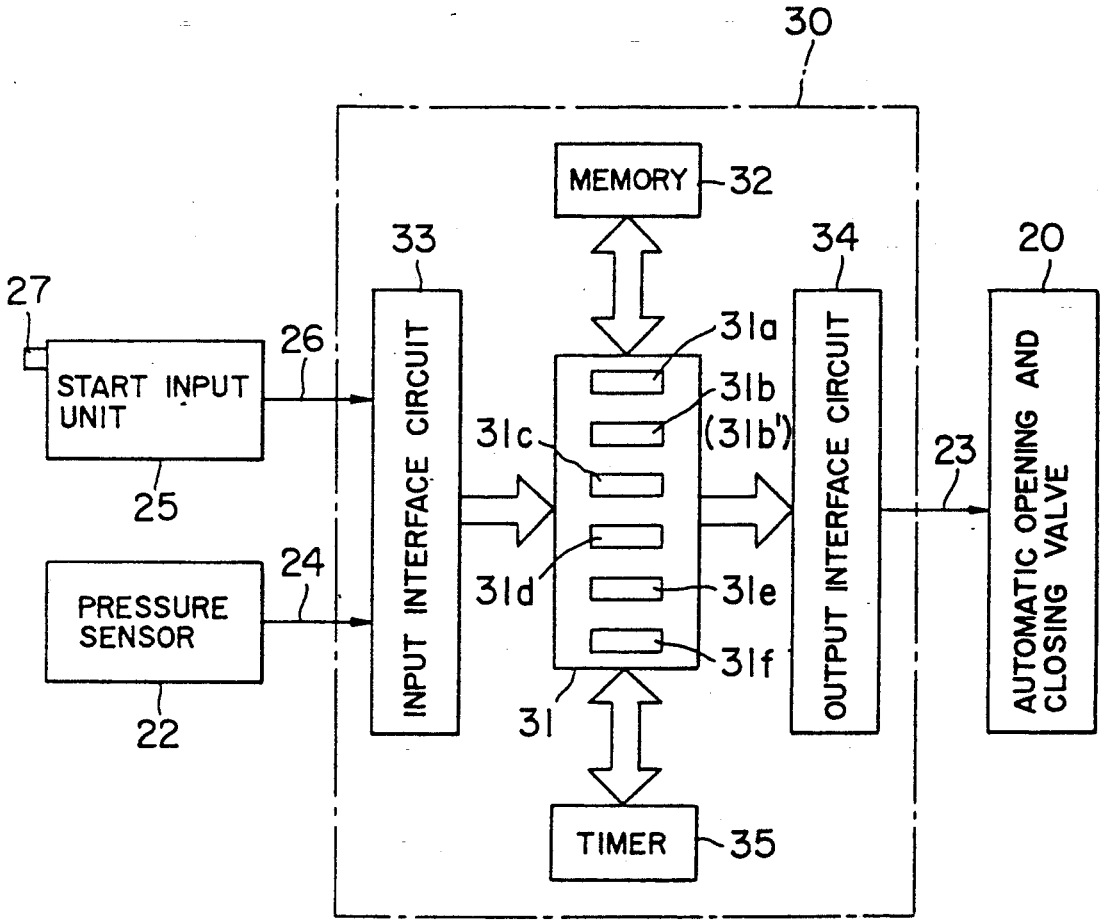

FIG. 1 and FIG. 2 indicate a first example of the water closet flushing apparatus according to the present invention. A flushing water closet 10 is provided with a bowl shape bowl portion 11 into which solid and liquid excreta is received and held. The bowl portion 11 is divided into two portions by a partition 11*a* so that the two portions communicate at the bottom portion of the bowl portion 11. That is, a trap discharge passage 12 having the shape of an inverted letter "U", is communicated with the bottom portion of the bowl portion 11. The bowl portion 11 is also provided with a rim portion 13 formed so as to surround the circular upper edge of the bowl portion 11. The rim portion 13 is formed so that it is hollow on the inside, and so as to form a flow passage 13*a* for the flushing water. One portion of the flow passage 13*a* is enlarged to form a water supply chamber 13*d* and a water supply inlet 13*b* for the flushing water opens into this water supply chamber 13*d*. Furthermore, the rim portion 13 has a plural number of flushing water supply holes 13*c* opened on its circular periphery and which communicate with the flow passage 13*a*. These flushing water supply holes 13*c* are opened in the diagonally downwards direction with respect to an inside wall surface of the bowl portion 11. For example, the flushing water supply holes 13*c* are opened diagonally downwards so that the direction of discharge of the flushing water is at an angle of approximately 45. from the horizontal direction. By this, the discharged flushing water is made to flow as a vortex along the inside of the bowl portion 11.

The trap discharge passage 12 has a flow inlet 12*a* formed between the bottom portion of the bowl portion 11 and a distal end portion 11*b* of the partition wall 11*a*. In addition, the bent portion of the trap discharge passage 12 that has the shape of an inverted letter "U" forms a spillway 12*b* so that the flushing water W spills over the trap discharge passage 12 and is discharged. A discharge passage 12*c* on the side downstream of the trap discharge passage 12 has the shape of a straight tube and is disposed in the vertical direction, with its lower end forming a discharge outlet 12*d*.

Above the water supply chamber 13*d* of the flushing water closet 10 is provided with a cover 17 that configures a machine housing chamber 16 that houses a flushing water supply control mechanism. A flushing water supply pipe 19 (water supply pipe) connected to a flushing water supply source 18, passes through the cover 17 into the machine housing chamber 16.

A flushing water supply pipe 19 is connected to the water supply inlet 13*b* that opens to the water supply chamber 13*d* and along it is provided an automatic opening and closing valve 20 that opens and closes the water supply path of the flushing water supply pipe 19. This automatic opening and closing valve 20 can use a solenoid opening and closing valve to perform valve opening operation for the conducting status.

On the flushing water supply pipe 19 in the vicinity of the water supply inlet 13*b*, is mounted an atmospheric vacuum breaker 21 and on the flushing water supply pipe 19 between this atmospheric vacuum breaker 21 and the automatic opening and closing valve 20 is mounted a pressure sensor 22 that detects the pressure of the flushing water inside the flushing water supply pipe 19. This pressure sensor 22 can use a sensor of the semiconductor or piezo-ceramic type, or of the electrostatic capacitance type. Moreover, in the present embodiment the pressure sensor 22 is mounted along the water supply pipe 19 separately from the automatic opening and closing valve 20 but the pressure sensor 22 can also be integrated with the automatic opening and closing valve 20 and the like to form a valve unit which is mounted to the water supply pipe 19. In this case, the entire apparatus becomes more compact and easier to assemble.

A control device 30 is disposed inside the machine housing chamber 16 and this control device 30 is respectively connected to the automatic opening and closing valve 20 and the pressure sensor 22 by signal lines 23 and 24. In addition, the control device 30 is connected by a signal line 26 to a start input portion 25 that is provided with sensors and the like that generate operation start signals, or to a various switches for operation of the flushing water supply device apparatus. These various types of switches for operation include a selector switch to select the water supply amount of the flushing water in accordance with the purpose of use, an a manual switch to start the flushing water supply apparatus. In addition, the sensors that generate the operation start signal can be a seat pressure sensor that detects when a person is sitting on the seat, for example.

As indicated in FIG. 2, the control device 30 is provided with a microprocessor (MPU), a memory 32, an input interface circuit 33, and an output interface circuit 34. The microprocessor 31 is connected to a timer 35 and is also provided with some kinds of means that perform various types of calculations in order to perform opening and closing control of the automatic opening and closing valve 20. More specifically, it is provided with a pressure difference calculation means 31*a* that calculates the difference between the pressure detected by the pressure sensor 22 when the automatic opening and closing valve 20 is in the closed status, and the pressure detected by the pressure sensor 22 when the automatic opening and closing valve 20 is in the open status. A compensation instantaneous flow amount calculation means 31*b* is provided to use this pressure difference calculated by the pressure difference calculation means 31*a* as the basis for calculating the instantaneous flow amount of flushing water flowing inside the flushing water supply pipe 19. In addition, a valve opening time calculation means 31*c* is provided to use the instantaneous flow amount calculated by this compensation instantaneous flow amount calculation means 31*b*, as the basis for calculating the valve opening time necessary in order to supply the predetermined water supply amount to the water closet.

In addition, in this embodiment, the microprocessor 31 is also provided with a water supply amount setting means 31*d* that sets the necessary amount of flushing water that has to be supplied to the water closet. The set value for this necessary water supply amount is determined by the relationship between the instantaneous flow amount (predetermined instantaneous flow amount) for obtaining the optimum flushing effect, and the valve opening time. Normally, when the actual instantaneous flow amount is greater than the predetermined instantaneous flow amount, the valve opening time is shortened and the predetermined water supply amount is supplied so that there is no lowering of the flushing effect. However, there are instances where a sufficient flushing effect cannot be obtained by simply lengthening the valve opening time when the actual instantaneous flow amount is less than the predetermined instantaneous flow amount. Because of this, the present embodiment is also provided with an instantaneous flow amount comparison means 31*e* that compares the predetermined instantaneous flow amount determined beforehand, with the actual instantaneous instantaneous flow amount that was calculated, and a water supply amount set value changing means 31*f* that generates instruction signals to increase the set water supply amount of the water supply amount setting means 31*d* when the actual instantaneous flow amount is smaller than the predetermined instantaneous flow amount. More specifically, the instruction signals from this water supply amount set value changing means 31*f* increase the set value for the necessary water supply amount so that the opening time of the automatic opening and closing valve 20 is further lengthened. The set value described above is stored in the memory 32.

The input interface circuit 33 of the control device 30 is connected to the signal line 26 from the start input portion 25 that is provided with a start switch 27, and the signal line 24 from the pressure sensor 22 provided to the flushing water supply pipe 19. In addition, the output interface circuit 34 of the control device 30 is connected to the signal line 23 to the automatic opening and closing valve 20, so that opening and closing operation instruction signals are sent to the automatic opening and closing valve 20.

Figure 3:
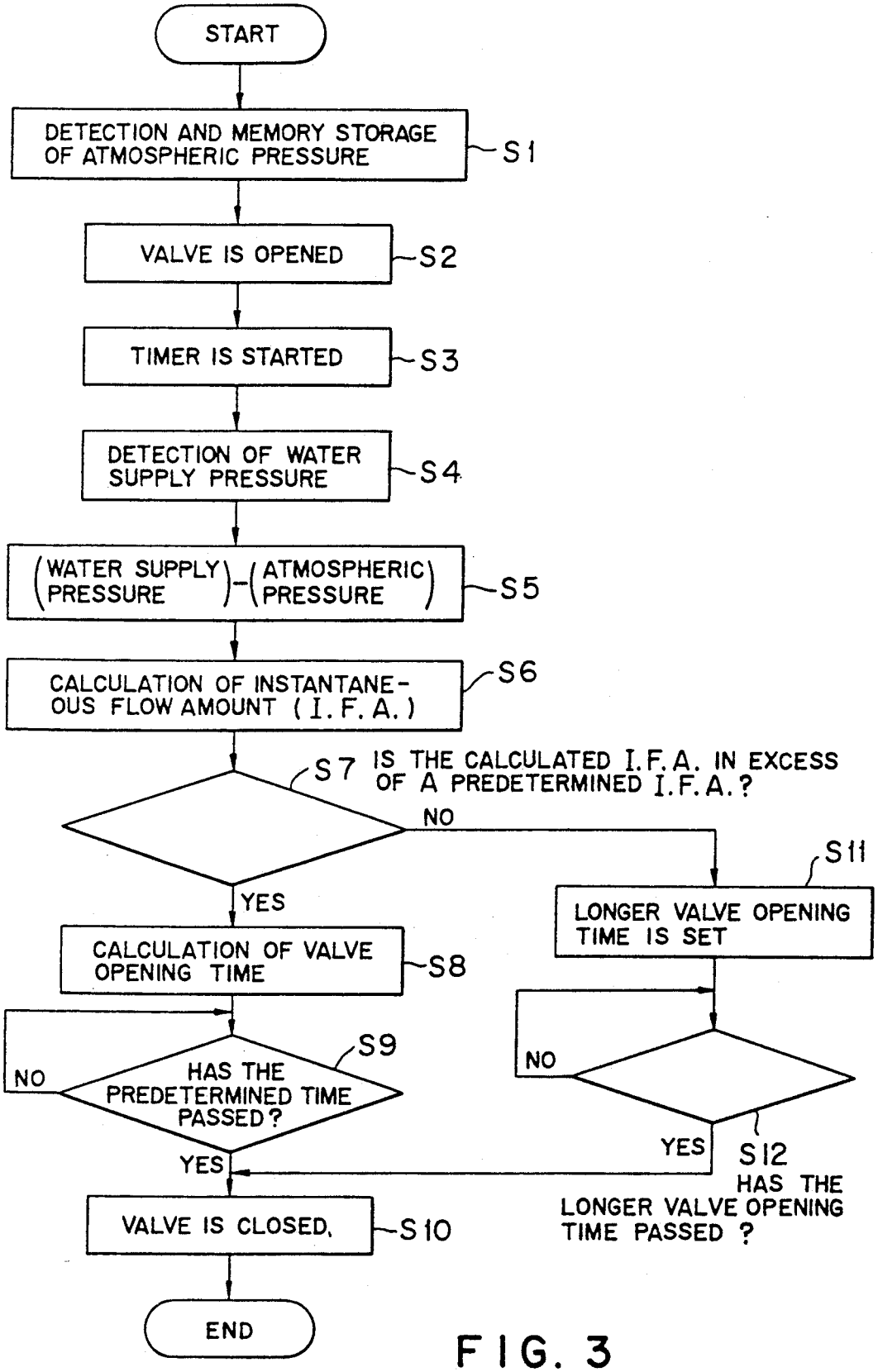
FIG. 3 is a flow chart indicating the flushing process of the apparatus according to a first embodiment.

The following is a description of the operation sequence of the flushing water supply apparatus according to this embodiment, with reference to FIG. 3.

The operation of the flushing water apparatus starts when the start switch 27 turns ON automatically because of the photo-sensor, or the manual or seat pressure switch. First of all, in the status where the automatic opening and closing valve 20 is closed, the pressure is detected by the pressure sensor 22. This detect pressure expresses the atmospheric pressure. This pressure is stored in the memory 32 (step S1).

Then, the instruction signal to open the automatic opening and closing valve 20 is sent from the microprocessor 31 to the automatic opening and closing valve 20 and the automatic opening and closing valve 20 performs opening operation (step S2). The time count by the timer 35 starts when there is this valve open operation (step S3).

The opening of the automatic opening and closing valve 20 causes the flushing water to pass from the flushing water supply source 18, through the flushing water supply pipe 19 and to be supplied to water supply inlet 13*b* of the water closet. The flushing water that flows from the water supply inlet 13*b* and into the flow passage 13*a* of the rim portion 13 is discharged from the flushing water supply holes 13*c* and runs in a vortex manner down into the bowl portion 11. This starts the flushing inside the bowl portion 11.

After the supply of flushing water has started, the pressure sensor 22 again detects the pressure (step S4). The pressure obtained from this pressure detection is the water supply pressure during water supply. Then, the pressure difference between the water supply pressure and the atmospheric pressure stored in the memory 32 is calculated by the pressure difference calculation means 31*a* (step S5). This pressure difference is used as the basis for the calculation of the instantaneous flow amount of the flushing water by the compensation instantaneous flow amount calculation means 31*b* (step S6). The instantaneous flow calculated in accordance with the formula $Qi = C\sqrt{\Delta P}$, where C is a constant and $\Delta P$ is the pressure difference.

This calculated instantaneous flow amount and the predetermined instantaneous flow amount stored in the memory 32 are compared by the instantaneous flow amount comparison means 31*e* (step S7). If the calculated instantaneous flow amount is equal to or greater than the predetermined instantaneous flow amount, then the valve opening time calculation means 31*c* calculates the valve opening time for the automatic opening and closing valve 20 and stores it in the memory 32 (step S8). This valve opening time is calculated by the set value for the necessary water supply amount and the calculated value for the instantaneous flow amount.

In the microprocessor 31, the time count signal from the timer 35 is compared with the valve opening time signal from the memory 32 and a judgment is made as to whether or not the predetermined valve opening time has elapsed (step S9).

If the predetermined valve opening time has elapsed, then the valve close instruction signal is sent from the microprocessor 31 to the automatic opening and closing valve 20 and the automatic opening and closing valve 20 is closed (step S10).

During this time, flushing water of the amount necessary for flushing is supplied to the flushing water closet 10 by the valve open operation. The flushing water that has flushed the bowl portion 11, then flows to the trap discharge passage 12 and is discharged from the discharge outlet 12*d*. This discharge operation creates a negative pressure inside the discharge passage 12*c* and generates a siphon action in the trap discharge passage 12 so that solid and liquid excreta inside the bowl portion 11 pass over the spillway 12*b* and are discharged along the discharge passage 12*c* of the trap discharge passage 12.

On the other hand, when the calculated instantaneous flow amount is less than the predetermined instantaneous flow amount, an instruction signal for setting a long water supply time for a small flow amount is sent from the water supply amount set value changing means 31*f* to the water supply amount setting means 31*d* and the set value stored in the water supply amount setting means 31*d* for the necessary water supply amount is increased. As a result, the valve opening time of the automatic opening and closing valve 20 is set to longer than for the valve opening operation previously described, and that operating time is stored in the memory 32 (step S11).

After this, a judgment is made in the same manner as for step S9 described above, for as to whether the predetermined valve open time has elapsed (step S12). Then, if the predetermined valve open time has elapsed, a valve close instruction signal is sent from the microprocessor 31 to the automatic opening and closing valve 20 and the automatic opening and closing valve 20 is closed (step S10).

In this manner, when there is a small instantaneous flow amount, the supply of flushing water in an amount greater than the necessary predetermined water supply amount compensates for the extra time taken to generate the siphon action in the trap discharge passage 12.

In the present embodiment, the pressure sensor 22 is disposed downstream of the automatic opening and closing valve 20, and the atmospheric pressure is detected when the automatic opening and closing valve 20 is in the closed status, and the pressure difference between the atmospheric pressure and the water supply pressure is calculated, and this pressure difference can be used as the basis for compensating for the change in the amount of water due to variations in the atmospheric pressure.

With respect to control of the water supply amount, when it is not necessary to have a high degree of accuracy as in the case of the embodiment described above, it is possible to omit the process where the pressure difference between the atmospheric pressure and the water supply pressure is calculated. In this case, the water pressure is detected by the pressure sensor 22 after the opening operation for the automatic opening and closing valve 20 and this water supply pressure can be used as the basis for the direct calculation of the valve opening time that is necessary in order to obtain the predetermined water supply amount.

Alternatively, an instantaneous flow amount calculation means 31*b*' can be provided inside the microprocessor 31 and this instantaneous flow amount calculation means 31*b*' used to calculate the instantaneous flow amount on the basis of the detected pressure. After the instantaneous flow amount has been calculated by the instantaneous flow amount calculation means 31*b*', the opening time of the automatic opening and closing valve 20 is controlled in the same manner as for the embodiment described above.

In addition, in the embodiment described above, control of the water supply amount is performed by controlling the opening time of the automatic opening and closing valve 20 but instead of calculating the valve opening time, the instantaneous flow amount can be integrated and the water supply amount detected directly. As will be described in detail in the embodiment to be described later, this method can be realized by providing the microprocessor with a flow amount integration means to integrate the instantaneous flow amount, and a flow amount comparison means to compare this integrated flow amount and the predetermined water supply amount.

Figure 4:
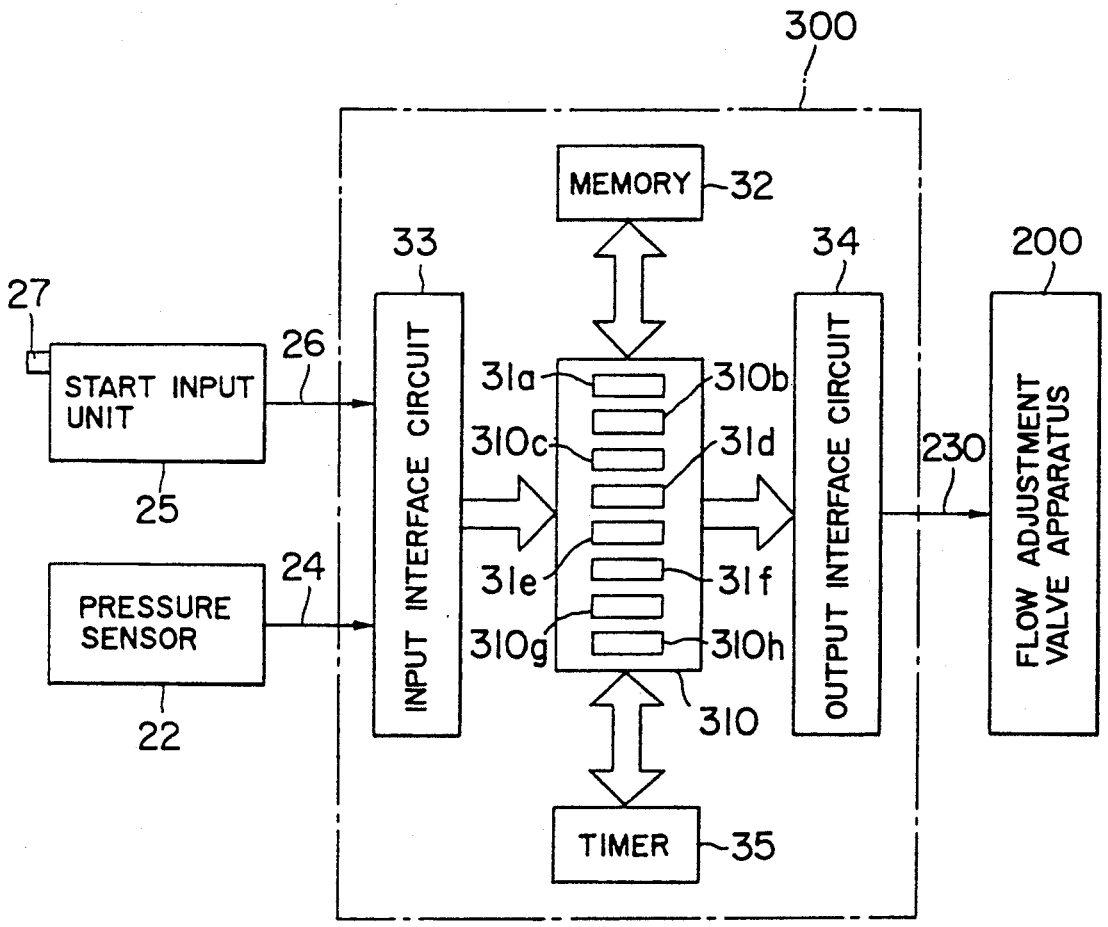
FIG. 4 is a block configuration view indicating a second embodiment of a water closet flushing apparatus according to the present invention.
Figure 5:
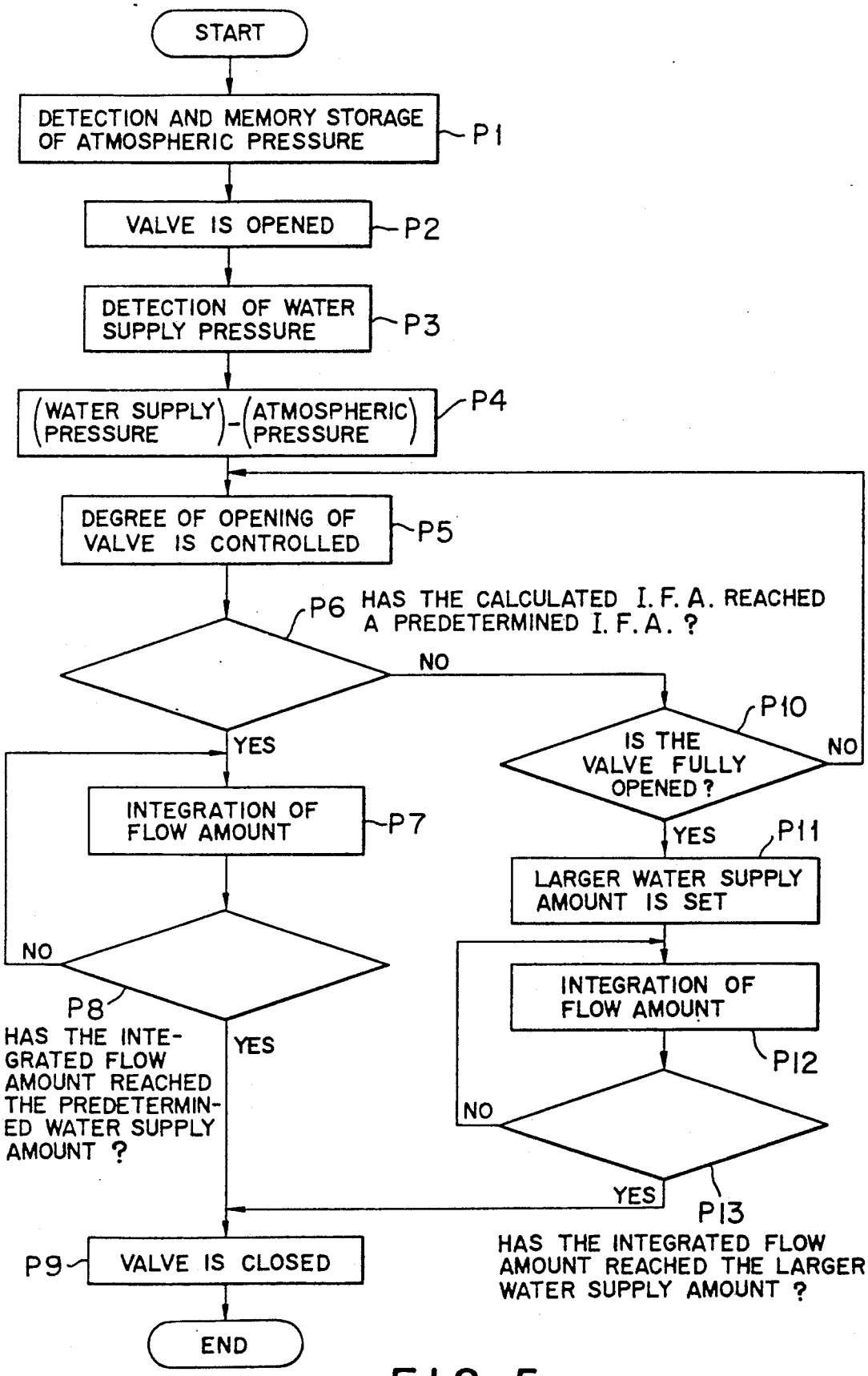
FIG. 5 is a flowchart indicating the flushing process of the apparatus according to the second embodiment.

FIG. 4 and FIG. 5 indicate a second embodiment of the water closet flushing apparatus according to the present invention.

In this embodiment, a flow adjustment valve apparatus 200 is used instead of the automatic opening and closing valve 20 used in the first embodiment. The flow adjustment valve apparatus 200 is an apparatus that enables the adjustment of the degree of valve opening so that it is possible to adjust the amount of flow that passes the valve apparatus.

In this embodiment, a microprocessor 310 for the control apparatus 300 connected by the signal line 230 to the flow adjustment valve apparatus 200 is, as for the first embodiment already described, provided with a pressure difference calculation means 31*a*, a water supply amount setting means 31*d*, a, instantaneous flow amount comparison means 31*e* and a water supply amount set value changing means 31*f*. In addition, it is also provided with an instantaneous flow amount calculation means 310*b* to use the pressure difference to calculate the instantaneous flow amount of flushing water, a valve opening compensation means 310*c* to calculate the necessary valve opening degree of the flow adjustment valve apparatus 200 on the basis of the results of comparison obtained by the instantaneous flow amount comparison means 31*e*, a flow amount integration means 310*g* to integrate the instantaneous flow amount calculated by the instantaneous flow amount calculation means 310*b*, and a comparison means 310*h* to compare this calculated integrated flow amount, and the predetermined water flow amount. This flow amount integration means 310*g* can use a method that counts waveform-shaped pulse signals on the basis of pressure signals of the pressure sensor 22, for example.

The other configuration elements of this second embodiment are the same as those for the first embodiment, with corresponding elements indicated with the same numerals and the corresponding descriptions for them omitted.

The following is a description of the operating sequence of a water closet flushing apparatus according to the second embodiment, with reference to FIG. 5.

The operation of the flushing water apparatus starts when the start switch 27 turns ON automatically because of the manual switch. First of all, in the status where the flow adjustment valve apparatus 200 is closed, the pressure is detected by the pressure sensor 22. This detected pressure expresses the atmospheric pressure. This pressure is stored in the memory 32 (step Pl).

Then, the instruction signal to open the flow adjustment valve apparatus 200 is sent from the microprocessor 310 to the flow adjustment valve apparatus 200 and the flow adjustment valve apparatus 200 opens according to a predetermined opening degree (step P2). This opening of the flow adjustment valve apparatus 200 causes the flushing water to be supplied to inside the bowl portion of the water closet and commence the flushing.

After the supply of flushing water has started, the pressure sensor 22 again detects the pressure (step P3). The pressure difference between the detected water supply pressure and the atmospheric pressure stored in the memory 32 is calculated by the pressure difference calculation means 31*a* (step P4). This pressure difference is used as the basis for the calculation of the instantaneous flow of the flushing water by the compensation instantaneous flow amount calculation means 310*b* and this instantaneous flow amount and the predetermined instantaneous flow amount stored in the memory 32 are compared by the instantaneous flow amount comparison means 31*e*. The valve opening compensation means 310*c* is used to calculate the necessary degree of opening of the flow adjustment valve apparatus 200, on the basis of the results of comparison, and to change the degree of opening of the flow adjustment valve apparatus 200 (step P5).

A judgment is then made for whether the instantaneous flow amount calculated after the instantaneous flow amount has been changed by adjusting the degree of valve opening, has reached the predetermined instantaneous flow amount (step P6). If it is judged as having reached the predetermined instantaneous flow amount, then the flow amount integration means 310*g* is used to integrate the instantaneous flow amount (step P7). Then, the comparison means 310*h* is used to compare the value for the integrated flow amount, with the predetermined water supply value amount that is stored in the memory 32 , and a judgment is made as to whether or not the integrated water supply amount of the flushing water has reached the predetermined value (step P8).

If it is judged that the integrated water supply amount has reached the predetermined water supply amount, then a valve closing instruction signal is sent to the flow adjustment valve apparatus 200 and the flow adjustment valve apparatus 200 is closed (step P9).

By the above series of operations, flushing water of the necessary water supply amount is sent to the water closet and flushing is performed.

On the other hand, when the calculated instantaneous flow amount is less than the predetermined instantaneous flow amount, a judgment is first performed for whether the flow adjustment valve apparatus 200 is in the state where it is fully opened (step P10). When the valve opening degree is not at its maximum, the flow adjustment valve apparatus 200 operates further to that the valve opening degree is made larger. When the valve opening degree is at its maximum, a long water supply setting instruction signals for a small water supply amount is sent to the water supply amount setting means 31*d* from the water supply amount set value changing means 31*f* and the set value for the necessary water supply amount that has been set and stored on the water supply amount setting means 31*d* is increased (step P11).

After this, in the same manner as for step P7 above, the flow amount integration means 310*g* is used and a judgment is performed for whether or not the set water supply amount has been supplied (step P13). Then when the increased, predetermined water supply amount has been attained, the flow adjustment valve apparatus 200 is closed (step P9).

In this manner, this embodiment also increases the necessary predetermined water supply amount when the instantaneous flow amount is small and enables a definite flushing effect to be obtained.

In this embodiment, the pressure sensor 22 is disposed downstream of the flow adjustment valve apparatus 200, and the atmospheric pressure is detected when the flow adjustment valve apparatus 200 is in the closed status, and the pressure difference is used as the basis for the calculation of the instantaneous flow amount but the description of the process for the calculation of the pressure difference between the atmospheric pressure and the water supply pressure is omitted because it has already been described for the first embodiment. In this case, after the opening operation for the flow adjustment valve apparatus 200, the water supply pressure is detected by the pressure sensor 22 and this water supply pressure is used as the basis for the direct calculation of the degree of opening of the flow adjustment valve apparatus 200 that is necessary in order to obtain the predetermined water supply amount.

In the first embodiment and the second embodiment that have been described above, the pressure sensor 22 is disposed downstream of the opening and closing means but in the third embodiment of the present invention and which is described in the following, the pressure sensor 22 is disposed upstream of the opening and closing means.

Figure 6:
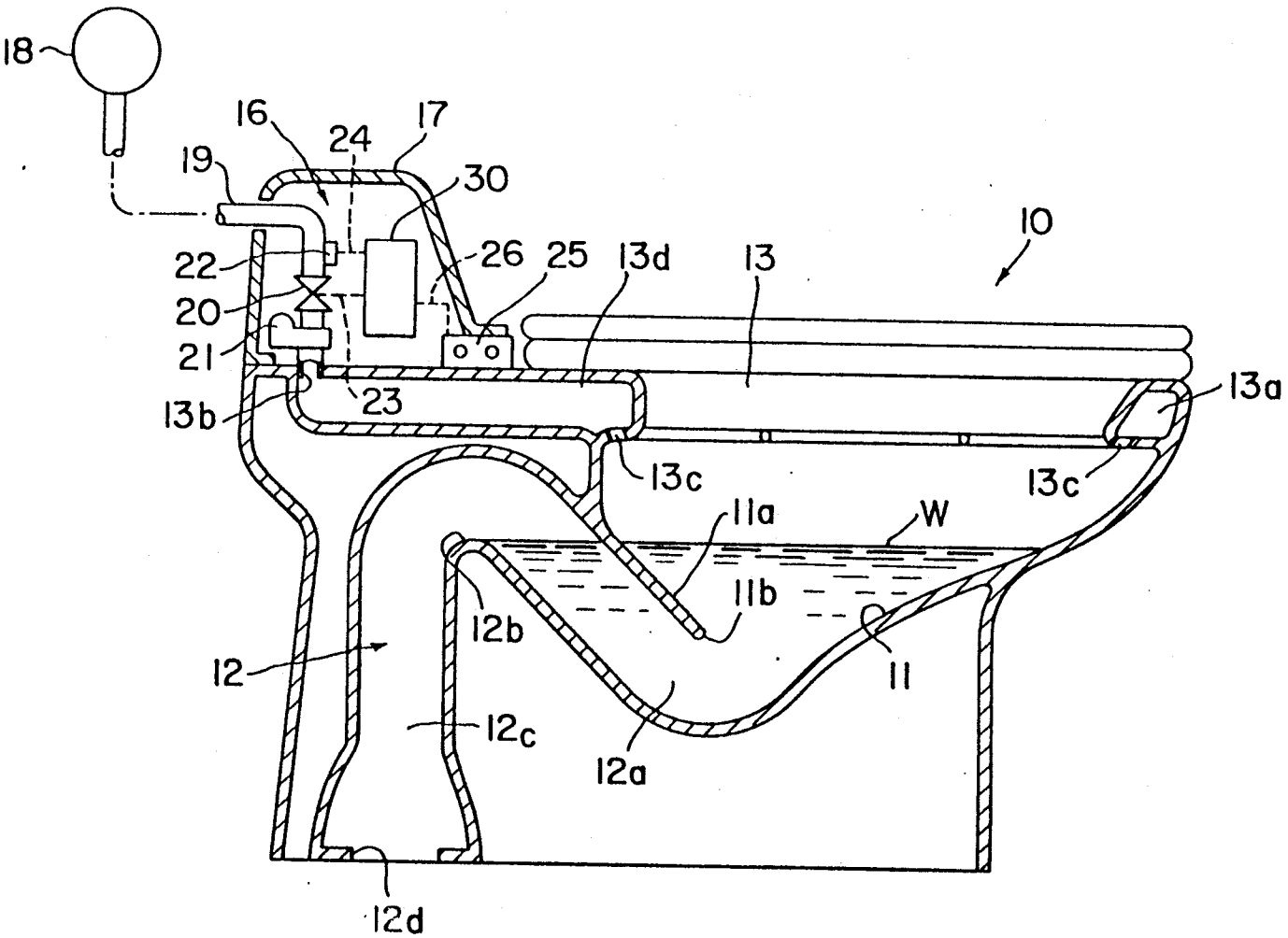
FIG. 6 is equivalent to FIG. 1, and is a sectional view indicating the example of the application of a third embodiment of the present invention to a flushing water closet.

FIG. 6 is a view of a third embodiment according to the present invention. The apparatus of this embodiment is characterized in that the pressure sensor 22 is disposed upstream of the automatic opening and closing valve 20 but the other configuring elements are the same as those for the first embodiment, are indicated with the same numerals, and the corresponding descriptions for them are omitted.

The apparatus according to this embodiment differs from that of the first embodiment described above in that it is possible to detect the water supply pressure when the automatic opening and closing valve 20 is in the closed status (still water status).

Figure 7:
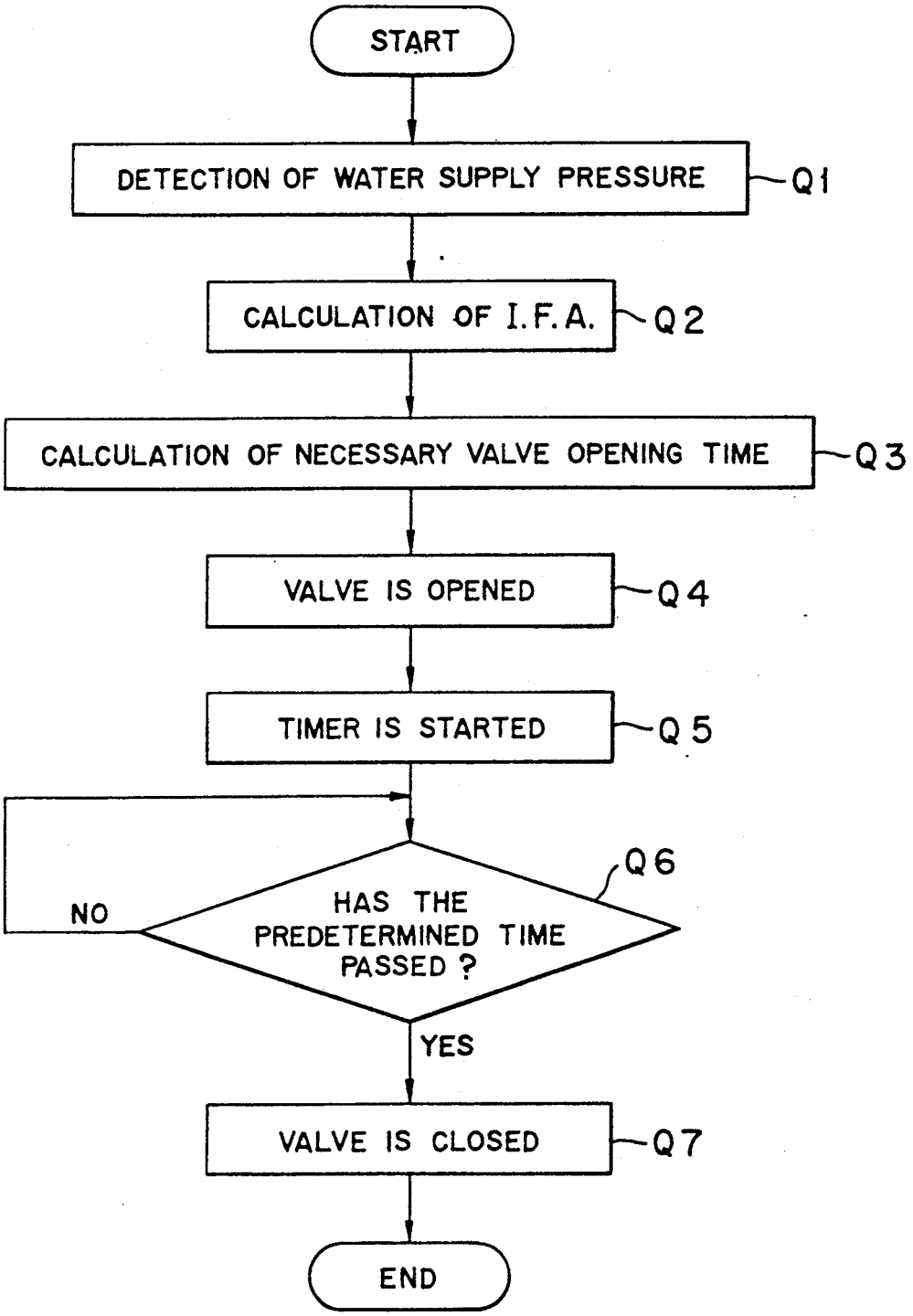
FIG. 7 is a flow chart indicating the flushing process of an apparatus according to a third embodiment.

The following is a description of the operation of the apparatus according to the third embodiment, with reference to FIG. 7.

First of all, the operation of the flushing water apparatus starts when the start switch turns ON, and the water supply pressure when the water is in the still status is detected by the pressure sensor 22 (step Q1). This water supply pressure P is used as the basis for the calculation of the instantaneous flow amount of the flush in water $Q_i$ in accordance with the formula $Qi = C\sqrt{\Delta P}$ (step Q2), where C is a constant. Then this calculated instantaneous flow amount $Q_i$ is used to determine the necessary valve opening time in order to obtain the predetermined water supply amount, and this determined value is stored in the memory (step Q3). In this manner, after the necessary valve opening time has been calculated, the automatic opening and closing valve 20 opens and the supply of flushing water commences (step Q4). At the same time the timer is started and the time count commences (step Q5). While there is supply operation for the flushing water, the necessary valve opening time stored in the memory is compared with the time counted by the timer and when judgment is continuously performed for whether the predetermined time has elapsed (step Q6). When the predetermined time has elapsed, the automatic opening and closing valve close instruction signal is given and the automatic opening and closing valve 20 closes (step Q7).

As has already been described for the previous embodiments, in cases where the instantaneous flow amount does not reach the predetermined value, this embodiment can also lengthen the opening time of the automatic opening and closing valve 20 and increase the flow amount of the flushing water supplied.

In addition, instead of the automatic opening and closing valve 20 in this embodiment, it is also possible to use a flow adjustment valve apparatus. In cases where the pressure sensor 22 is disposed upstream of the flow adjustment valve apparatus, the difference with the apparatus of the second embodiment is that it is possible to detect the water supply pressure when the flow adjustment valve apparatus is in the closed status (still water status). This detected water supply pressure is used as the basis for the calculation of the instantaneous flow amount and as described for the second embodiment, it is possible to determine and control the degree of valve opening of the flow adjustment valve apparatus beforehand. In addition, integration of the flow amount is performed so that it is also possible to perform supply control for the predetermined water supply amount.

Furthermore, according to this embodiment, it is also possible to know beforehand when there is a negative pressure in the water supply pipe, and therefore prevent the occurrence of the reverse flow of water into the water closet. Still furthermore, it is also possible to detect abnormal pressures inside the water supply pipes and to know beforehand when the water supply outlet is blocked.

Figure 8:
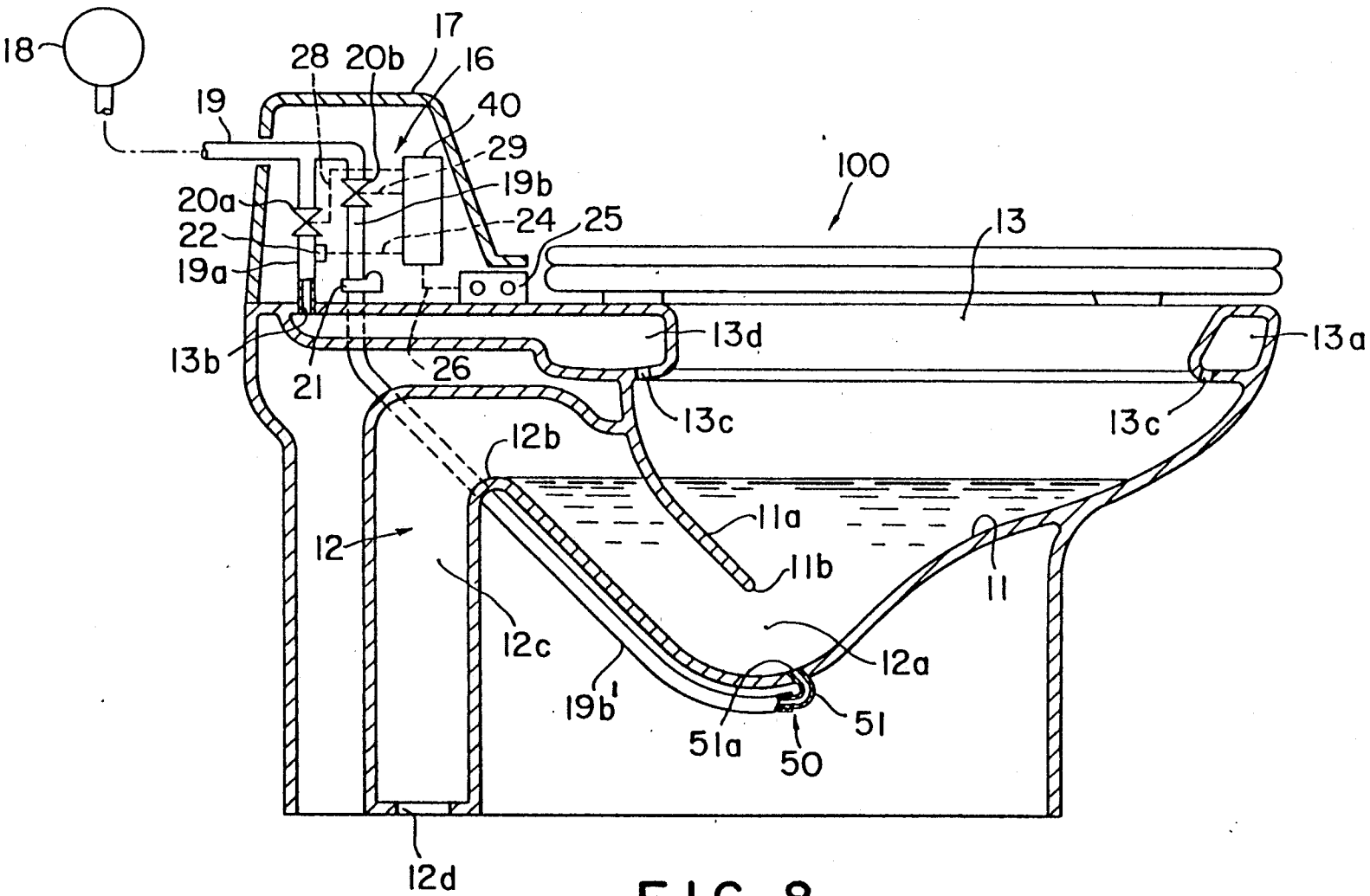
FIG. 8 and FIG. 9 indicate a fourth embodiment of the water closet flushing apparatus according to the present invention, with FIG. 8 being a sectional view indicating the example of the application of the present invention to a flushing water closet, and FIG. 9 being a block diagram indicating the configuration of the main portions of the apparatus.

FIG. 8 indicates a fourth embodiment according to the present invention. In this embodiment, the flushing water supply pipe 19 is branched midway into the two portions 19*a* and 19*b*.

The flushing water closet 100 indicated in FIG. 8 has a similar structure to the flushing water closet 10 indicated in FIG. 1, but differs in that the flushing water supply pipe 19 branches into a branched pipe (rim branch pipe) 19*a* which is connected to the water supply chamber 13*d* of the rim portion 13, and the branched pipe (jet branch pipe) 19*b* which is connected to the jet discharge portion 50. Along the rim branch 19*a* is provided an automatic opening and closing valve 20*a* for the rim and on the rim branch pipe 19*a* on the side downstream of this automatic opening and closing valve 20*a* is mounted a pressure sensor 22. In addition, along the jet branch pipe 19*b* is provided an automatic opening and closing valve 20*b* for the jet and at a position downstream of this is provided an atmospheric vacuum breaker 21. The jet branch pipe 19*b* extends further downwards, and this extension portion 19*b*, is connected to the jet discharge nozzle 51 that is mounted to the bottom portion of the bowl portion 11. This jet discharge nozzle 51 is disposed so that the jet holes 51*a* are in the direction of the flow inlet 12*a* of the trap discharge passage 12.

Figure 9:
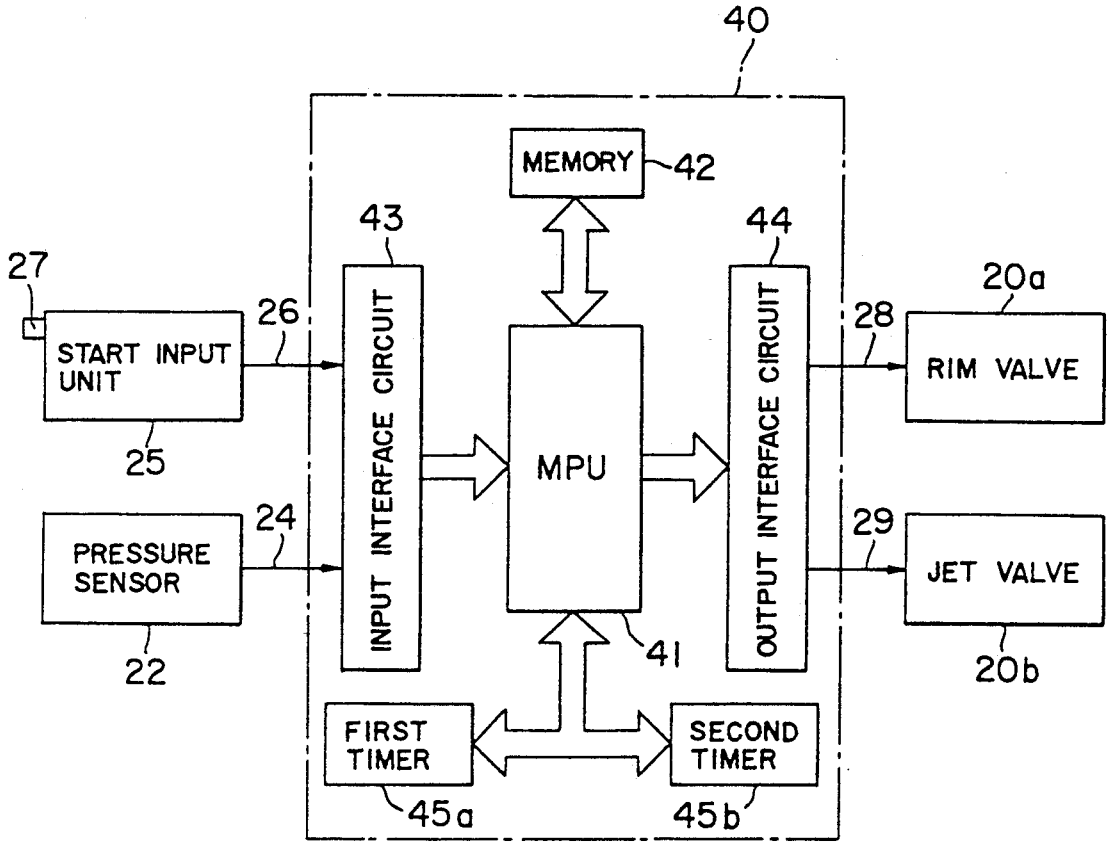

A control apparatus 40 is disposed inside the machine housing chamber 16 and is connected to the rim valve 20*a*, the jet valve 20*b*, the pressure sensor 22 by the respective signal lines 28,29 and 24. As indicated in FIG. 9, the control apparatus 40 is provided with a microprocessor 41, a memory 42, an input interface circuit 43 and an output interface circuit 44. In addition, the microprocessor 41 is also connected to a first timer 45*a* and a second timer 45*b*, respectively. The input interface circuit 43 is connected to the signal line 26 from the start input portion 25 and the signal line 24 from the pressure sensor 22. In addition, the output interface circuit 44 is connected to the signal lines 28 and 29 from the rim valve 20*a* and the jet valve 20*b*. The other portions of the configuration are the same as those indicated for the flushing water closet 10 of FIG. 1, are indicated with the same numerals and the corresponding descriptions of them are omitted.

Figure 10:
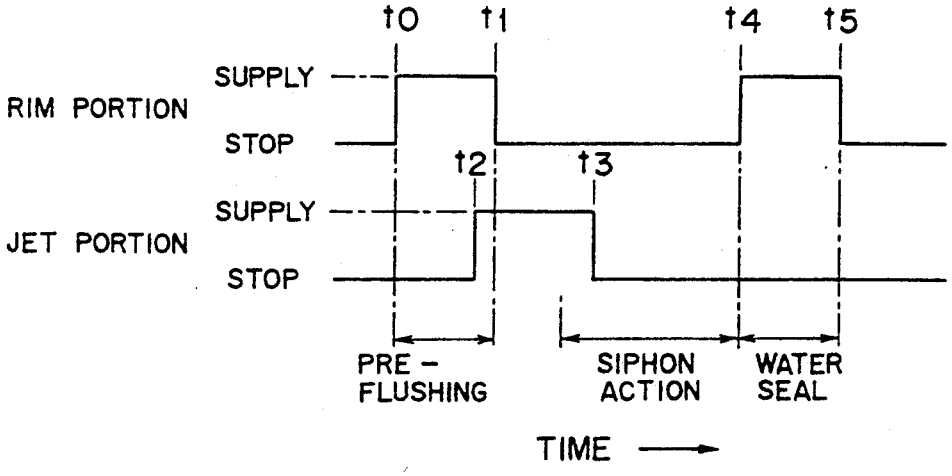
FIG. 10 and FIG. 11 are respectively, a timing chart indicating an example of the operation of the apparatus according to a fourth embodiment, and a flow chart indicating the flushing process of the apparatus according to a fourth embodiment.
Figure 11:
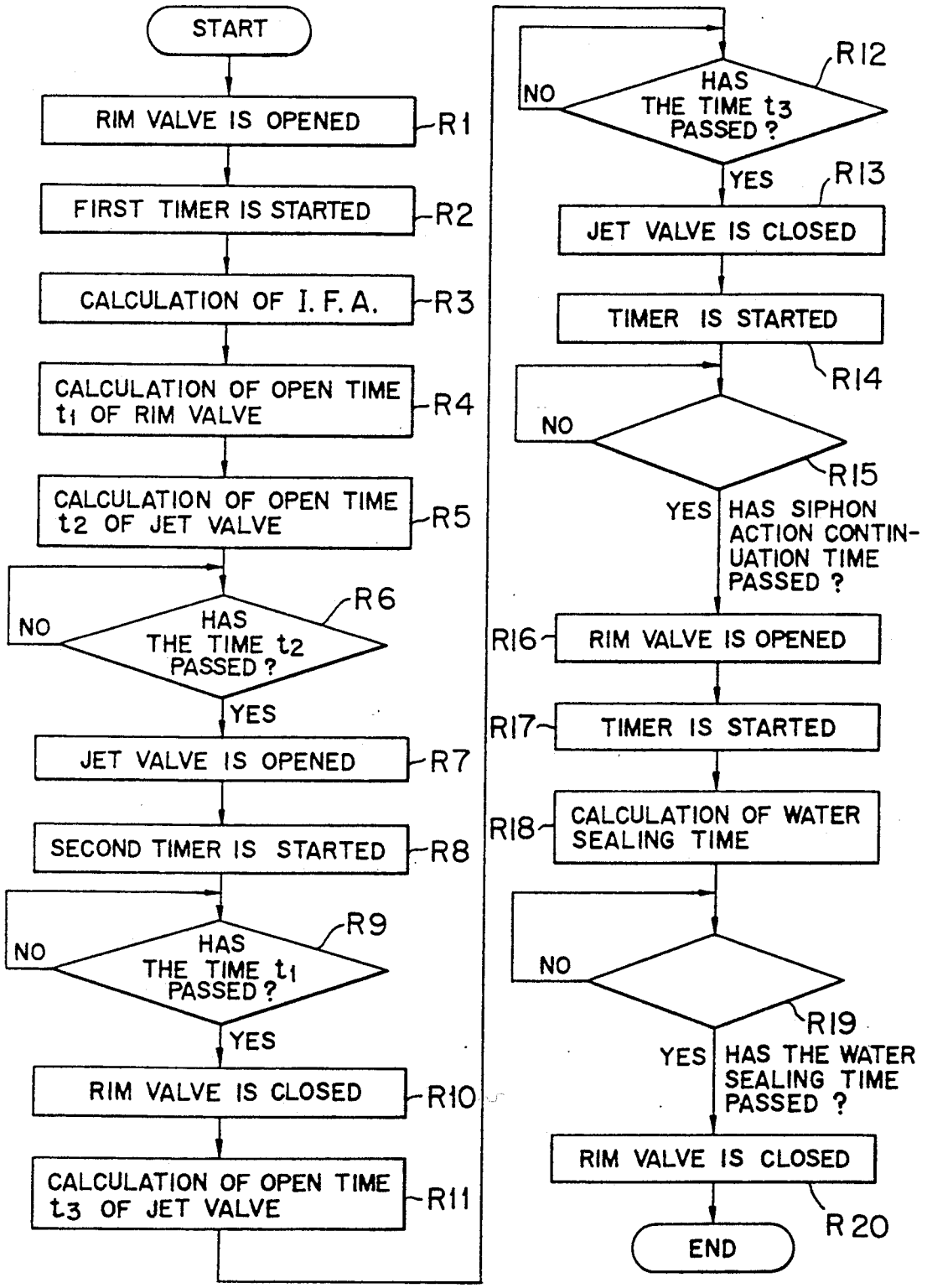

FIG. 10 and FIG. 11 are respectively, a timing chart and a flow chart of one example of the operation of the apparatus relating to the fourth embodiment. The following is a description of the operation of this embodiment, with reference to FIG. 10 and FIG. 11.

In this embodiment, as indicated in FIG. 10, the flushing water is supplied to the rim portion 13 during the time from $t_0$ to $t_1$ and performs pre-flushing. During this pre-flushing, a vortex flow of flushing water is formed inside the bowl portion 11 and performs flushing of the inside of the bowl portion 11. Immediately before this pre-flushing finishes, and after the time t2 has elapsed from the supply of the flushing water, the flushing water supply from the jet discharge portion 50 is started and continues until the time t3 has elapsed. The discharge of this flushing water from the jet discharge portion 50 generates a siphon effect inside the trap discharge passage 12 and is discharged from the trap discharge passage 12 along with the flushing water that was supplied for the pre-flushing. After the siphon effect has been generated and the excreta and the flushing water inside the bowl portion 11 have been discharged, flushing water is again supplied to the rim portion 13 and this flushing water is stored inside the bowl portion 11 to water-seal the water closet.

This series of flushing water supply operation described above, will be described in further detail, with respect to the flowchart in FIG. 11.

When the start switch 27 is turned ON, the flushing water supply operation for the flushing water closet apparatus starts. First, the rim valve 20*a* is driven to the open status (step R1), and then the first timer 45*a* is started (step R2). The flushing water passes inside the rim branch pipe 19*a* and is supplied to the water supply chamber 13*d*. The water supply pressure is detected by the pressure sensor 22 and is stored in the memory 42 inside the control apparatus 40. The microprocessor 41 uses this detected water supply pressure as the basis for calculating the instantaneous flow amount of flushing water (step R3). Then, the water flow amount data for pre flushing by water supply to the bowl portion 11 is read and the calculated instantaneous flow amount is used as the basis for the calculation of open time $t_1$ of the rim valve 20*a* (i.e. The bowl portion water supply time) (step R4). In addition, the memory 42 stores the relationship data for the water flow amount for pre-flushing of the bowl portion 11, and the timing for the start of flushing water supply from the jet discharge portion 50 and to generate the siphon effect. This relationship data is read and on the instantaneous flow amount previously calculated is used as the basis for the calculation of the start time *t2* for jet flushing water supply to the jet (step R5).

While flushing water is being supplied to the bowl portion 11, the time is counted by the first timer 45*a* and a judgment is made as to whether the start time $t_2$ for jet flushing water has been passed (step R6). At the point when the time $t_2$ is reached, the microprocessor 41 sends an instruction signal to open the jet valve 20*b* and the jet valve 20*b* opens (step R7). At the same time, the second timer 45*b* is started and starts to count the jet water supply time (step R8).

The time count signals from the first timer 45a are used to perform a judgment for whether or not the necessary time $t_1$ for water supply to the bowl portion has elapsed (step R9). At the point where the time $t_1$ has been reached, the microprocessor 41 sends a signal to close the rim valve 20a and the rim valve 20a is closed (step R10). During the period until the time $t_1$, flushing water is supplied to the bowl portion 11. In addition, this supplied flushing water and the jet water that is supplied from the jet discharge portion 50 in the direction of the trap discharge passage 12 generates a siphon effect inside the trap discharge passage 12, and the excreta and the flushing water inside the bowl portion 11 passes along the trap discharge passage 12 and is discharged. This discharge action by the siphon effect continues even after the jet water supply and the water supply for pre-flushing to the bowl portion 11 has stopped, and stops when air flows under the distal end portion 11b of the partition wall 11a to inside the trap discharge passage 12.

The necessary water supply time for the jet flushing water is calculated on the basis of the water supply pressure data and the data for the necessary jet water supply amount stored inside the memory 42, and the time t3 for stopping of the jet water supply is calculated and stored in the memory 42 (step R11). The time for jet water supply is counted by the second timer 45b and a judgment is made for whether the time $t_3$ has been reached or not (step R12) At the time when the time $t_3$ is reached, the jet valve 20b is closed (step R13). With these steps, the pre. flushing of the wall surfaces of the bowl portion 11 and the supply of water to generate the siphon effect are completed.

At the same time as the jet valve 20b closes in step R13, the first or the second timer 45a or 45b are started and the siphon action continuation time is counted (step R14) The memory 42 stores the data for the siphon action continuation time and the count signals from the timer 45a (45b) are used as the basis for a judgment as to whether or not the siphon action continuation time has elapsed (step R15). At the time when the siphon action end time (time $t_4$) has been reached, open instruction signals are sent to the rim valve 20a and rim valve 20a is closed (step R16). By this, the supply of water for water-sealing is started to the bowl portion 11. At the same time as this, the first timer 45a is started and the count for the sealing-water water supply time is started (step R17). In addition, the necessary water supply data for water sealing and the supply water pressure data stored in the memory 42 are used as the basis for the calculation of the necessary water-sealing water supply time (step R18). The count signals for the water-sealing water supply time from the first timer 45a are used as the basis for judging whether or not the necessary water-sealing water supply time $t_5$ has been reached (step R19). At the time when the time $t_5$ is reached, the rim valve 20a is closed (step R20). By this, the bowl portion 11 sealing action is completed and the series of flushing operations is completed. In this embodiment, the description was given for when the pressure sensor 22 is mounted to only the rim branch pipe 19a but pressure sensors 22 can also be mounted to both the rim branch pipe 19a and the jet branch pipe 19b. If this is done, then in the status where both the rim valve 20a and the jet valve 20b are open and water supply action is performed, it is possible to have more accurate control for the water supply amount.

In addition, in the present embodiment, the opening and closing means for the flushing water supply pipe 19 was described as using automatic opening and closing valves 20a and 20b respectively provided to the rim branch pipe 19a and the jet branch pipe 19b but instead of these automatic opening and closing valves, it is possible to use the previously described flow adjustment valve apparatus. In addition, a two-way valve can also be used as the opening and closing means.

In addition, the water supply amount control method used for the flushing water can be the method described previously for the first, second and third embodiments. More specifically, it is also possible to apply a method that performs compensation for the water supply pressure due to variations in the atmospheric pressure, the method that increases the necessary water supply flow amount in cases where the instantaneous flow amount is less than a predetermined instantaneous flow amount, or the method wherein a pressure sensor is disposed on the upstream side of the opening and closing means.

Figure 12:
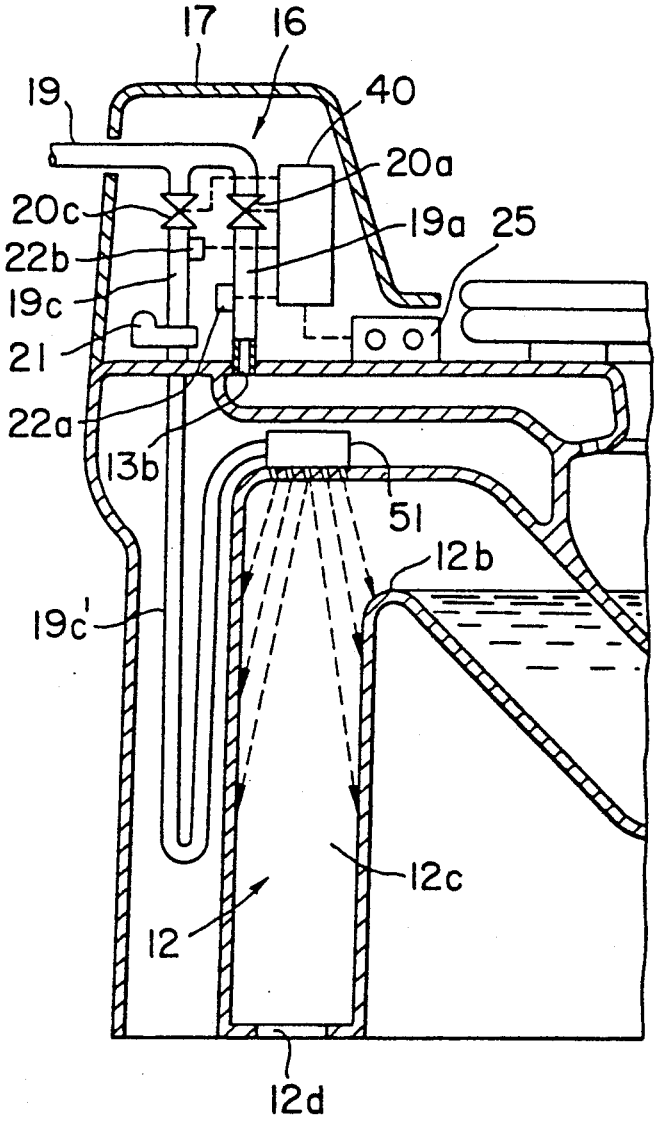
FIG. 12 is a sectional view indicating a modification of the embodiment indicated in FIG. 8.

FIG. 12 is a view of a modified configuration for the fourth embodiment. In this embodiment, the flushing water supply to generate the siphon effect is performed from a spray portion 51 provided at the top of the trap discharge passage 12. This spray portion 51 faces in the direction of the discharge passage 12c of the trap discharge passage 12, supplies a shower of flushing water, and is connected to the flushing water supply pipe 19 by the branch pipe 19c (shower branch pipe) via its extension 19c'. In addition, in this embodiment, pressure sensors are mounted on the rim branch pipe 19a and the shower branch pipe 19c, respectively. The control apparatus 40 is connected to the rim valve 20a, the shower valve 20c , the pressure sensors 22a and 22b, and the start input portion 25 by signal lines. The other elements of the configuration are the same as those described above for the fourth embodiment, are indicated with the same numerals, and the corresponding descriptions of them are omitted.

In this embodiment, control of the water supply amount is performed by the same process as described above for the fourth embodiment. More specifically, shower water supply is performed instead of the jet water supply already described, and effective generation of the siphon effect is performed. In addition, the sensors 22a and 22b are respectively mounted to the branched pipes 19a and 19c and so it is possible to have highly accurate control of the water supply amount.

Figure 13:
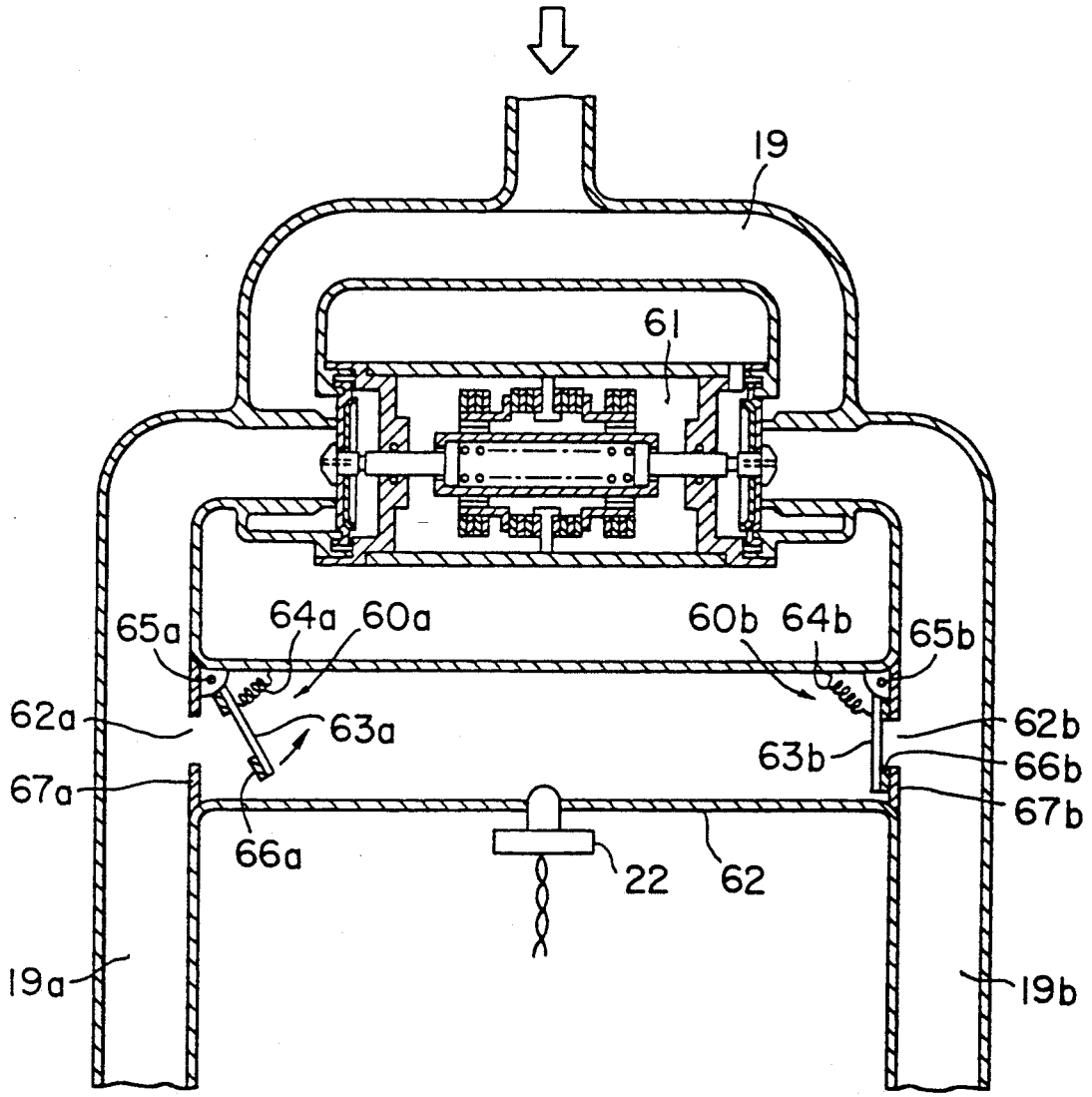
FIG. 13 is a partial, enlarged sectional view indicating one example of the method of installing the pressure sensor.

FIG. 13 indicates the example where it is possible to use a single pressure sensor to measure the water supply pressure in each of the branched pipes. In this embodiment, the flushing water supply pipe 19 is branched via a two-way valve 61, into the two branch pipes such as the rim branch pipe 19a and jet branch pipe 19b for example. The side walls of the rim branch pipe 19a and jet branch pipe 19b are respectively provided with open holes 62a and 62b which mutually communicate with a flow passage pipe 62 that connects the rim branch pipe 19a and jet branch pipe 19b. At both end portions of the flow passage pipe 62 are disposed reverse-flow stop valve mechanisms 60a, 60b that comprise water stop plates 63a, 63b that are mounted so as to be rockable on rocker shafts 65a, 65b fixed inside the flow passage pipe 62, spring members 64a, 64b that press these water stop plates 63a, 63b to the closed position, sealing packing 66a, 66b hat is mounted to the distal end portions of the water stop plates 63a, 63b, and ring-shaped valve sheets 67a, 67b that seals against the sealing packing 66a, 66b.

The pressure sensor 22 is mounted in the vicinity of the middle portion of the flow passage pipe 62.

According to an embodiment having such a configuration, when the two-way valve 61 operates and flushing water flows to the rim branch pipe 19*a*, the reverse-flow stop valve mechanism 60*a* on the side of the rim branch pipe 19*a* resists the pressing force to the spring member 64*a* because of the water supply pressure and rocks the water stop plate 63*a* so that the hole 62*a* is opened. By this, flushing water flows into the flow passage pipe 62 and the pressure is detected by the pressure sensor 22. The hole 62*b* on the side of the jet branch pipe 19*b* stays closed because of the water stop plate 63*b*.

In addition, when flushing water is also supplied to the side of the jet branch pipe 19*b*, the reverse-flow stop valve mechanism 60*b* on the side of the jet branch pipe 19*b* is opened in the same manner as has been described above and the flushing water that flows inside the jet ranch pipe 19*b* flows into the flow passage pipe 62 and the water supply pressure inside the jet branch pipe 19*b* is measured by the pressure sensor 22.

In this manner, according to the present embodiment, it is possible for the one pressure sensor to be used to measure the water supply pressure of two branch pipes.

As has been described above, according to the present invention, the pressure detection means is provided inside the water supply pipe for the supply of flushing water, and the pressure detected by this pressure detection means is used as the basis for opening and closing control of the water supply passage so that the predetermined amount of supply of flushing water is possible. When compared to the method of controlling the water supply amount through the use of a flow meter, the present invention enables instantaneous flow amount control with good response. In addition, it is also compact and has a small pressure loss and so it has the excellent advantage of being able to be effectively used in areas of low water pressure.

The present invention has a particularly excellent effect when applied to flushing water closets in places where there are variations in the water supply pressure due to the position of installation or the useage time.

We claim:

1. A water closet flushing apparatus for flushing a water closet having a bowl portion and a trap drainage passage shaped like an inverted letter "U" and provided with a spillover portion midway of the U-shape and adjacent to a lower portion of a bowl portion, comprising:

a water supply pipe forming a water supply passage through which flushing water flows connected between a flushing water supply source and the water closet;

a pressure detection means mounted along the water supply pipe;

an electrically operated, instantaneous flow adjustment means for adjusting an instantaneous flow amount of the flushing water within a range of flow rates provided along the water supply pipe; and a control means to control operation of said instantaneous flow adjustment means so that a predetermined supply water amount is supplied to the water closet on the basis of a pressure detected by said pressure detection means.

2. The water closet flushing apparatus of claim 1, wherein the instantaneous flow adjustment means is an instantaneous flow adjustment valve apparatus.

3. The water closet flushing apparatus of claim 2, wherein the control means uses the pressure detected by said pressure detection means as the basis for calculating the necessary opening degree of said instantaneous flow adjustment valve apparatus.

4. The water closet flushing apparatus of claim 2, wherein the control means has an instantaneous flow amount calculation means that uses the pressure detected by said pressure detection mans as the basis for calculating the instantaneous flow amount of the flushing water, a flow amount comparison means that compares said calculated instantaneous flow amount and the predetermined water supply amount and a valve opening degree compensation calculation means that uses the results of said comparison to calculate the necessary valve opening degree for said instantaneous flow adjustment valve apparatus.

5. The water closet flushing apparatus of claim 2, wherein the control means has an instantaneous flow amount calculation means that uses the pressure detected by said pressure detection mans as the basis for calculating the instantaneous flow amount of the flushing water, a flow amount integration means that integrates said calculated instantaneous flow amount, a flow amount comparison means that compares said integrated flow amount and the predetermined water supply amount, and a signal generation means that on the basis of the results of comparison, sends close operation signals to said instantaneous flow adjustment valve apparatus.

6. The water closet flushing apparatus of claim 1, wherein the control means has a water supply amount setting means that sets a preselected water supply amount for a desired flushing effect corresponding to a predetermined water supply pressure, a pressure comparison means that compares a pressure detected by said pressure detection means and the predetermined water supply pressure, and a water supply amount set valve changing means to increase the set water supply amount of said water supply amount setting means when said comparison indicates, in the state where the instantaneous flow adjustment means is fully opened, that the detected pressure is lower than the predetermined water supply pressure.

7. The water closet flushing apparatus of claim 1, wherein the control means has a water supply amount setting means that sets a predetermined water supply amount for a desired flushing effect corresponding to a predetermined instantaneous flow amount of flushing water, an instantaneous flow amount calculation means that uses the pressure detected by said pressure detection means as the basis for calculating the instantaneous flow amount of the flushing water, an instantaneous flow amount comparison means that compares said calculated instantaneous flow amount and the predetermined instantaneous flow amount, and a water supply amount set valve changing means that increases the set water supply amount of said water supply amount setting means when said comparison indicates, in the state where the instantaneous flow adjustment means is fully opened, that the instantaneous flow amount is lower than the predetermined instantaneous flow amount.

8. The apparatus of claim 1, wherein the pressure detection means is mounted at a position downstream of the instantaneous flow adjustment means.

9. The water closet flushing apparatus of claim 8, wherein the control means has a pressure difference calculation means to calculate the difference between a pressure detected by said pressure detection means when said instantaneous flow adjustment means is in a closed status, and a pressure detected by said pressure detection means when said instantaneous flow adjustment means is in an open status, a compensation instantaneous calculation means to calculate the instantaneous flow amount of the flushing water on the basis of the calculated pressure difference, and an instantaneous flow means to compare the calculated instantaneous flow amount and a predetermined instantaneous flow amount, said control means controlling the operation of the instantaneous flow adjustment means on the basis of the results of comparison so that a water supply amount is supplied to the water closet.

10. The water closet flushing apparatus of claim 1, wherein the pressure detection means is a pressure sensor.

11. The water closet flushing apparatus of claim 1, wherein the pressure detection means and the instantaneous flow adjustment means are integrated into one unit.

12. A water closet including passage means for conveying water from a water source to a bowl portion for flushing the bowl portion during a cycle of operation of the water closet, control means for controlling the flow of water through said passage means including an adjustable valve within said passage means for controlling the rate of water flow within a range of flow rates, and means responsive to a sensed water pressure within said passage means for automatically adjusting, as necessary, said valve during each cycle of operation of the water closet to cause the water to flow at preselected rate for admitting a first preselected amount of water into said bowl portion.

13. The water closet according to claim 12, wherein said means for automatically adjusting said valve is effective, under a condition of low water pressure from said water source whereby said preselected water flow rate is not attainable, for increasing the duration of water flow for admitting a second preselected amount of water into said bowl portion in excess of said first preselected amount.

* * * * *